US005566551A

United States Patent [19]

Cheng

[11] Patent Number: 5,566,551

[45] Date of Patent: Oct. 22, 1996

[54] VAPOR PRESSURE ENHANCEMENT (VPE) AIR COOLING-HEATING PROCESS AND APPARATUSES FOR USE THEREIN

[76] Inventor: Chen-Yen Cheng, c/o Dr. Wu-Cheng Cheng, 10308 Paddington Ct., Ellicott City, Md. 21042

[21] Appl. No.: 533,499

[22] Filed: Sep. 22, 1995

Related U.S. Application Data

[63] Continuation-in-part of Ser. No. 295,771, Aug. 29, 1994, Pat. No. 5,526,653.

[51] Int. Cl.[6] ..... B01D 9/04

[52] U.S. Cl. ..... 62/532; 62/123; 62/937

[58] Field of Search ..... 62/123, 532, 937

[56] References Cited

U.S. PATENT DOCUMENTS 4,810,274 3/1989 Cheng et al. ..... 62/532

5,061,306 10/1991 Cheng ..... 62/532

*Primary Examiner*—Ronald C. Capossela

[57] ABSTRACT

A Vapor Pressure Enhancement Air Cooler, designated as a VPE air cooler, a Vapor Pressure Enhancement Air Heater, designated as a VPE air heater, and a dual purpose integrated Vapor Pressure Enhancement Air Cooler/Heater, designated as a VPE air cooler/heater are introduced. A VPE air cooler comprises multiple pressure processing zones and is based on absorption vapor pressure enhancement operation. It comprises multitude of processing zones, Z-1, Z-2, . . . , Z-N that are operated under pressure $P_1$, $P_2$, . . . , $P_N$. Each pressure zone (Z-n) contains a water evaporation air cooling zone (Z-En), a vapor pressure enhancement zone (Z-VPEn) and a second vapor condensing zone (Z-Xn). There are a set heat transfer tubes with fins to provide water evaporation surfaces in the evaporation air cooling zone; there are flat heat conductive tubes for forming falling films of absorbing solution and falling films of water in the vapor pressure enhancement zone; there are condenser tubes in the condensation zone. A first vapor is absorbed and second vapor is generated in the enhancement zone: the second vapor is condensed in the condensing zone. Outdoor air, cooling water or air/water combination is used to remove the heat of condensation. The construction and operations of a VPE air heater are similar to those of a VPE air cooler.

20 Claims, 7 Drawing Sheets

VAPOR PRESSURE ENHANCEMENT (VPE) AIR COOLING-HEATING PROCESS AND APPARATUSES FOR USE THEREIN

RELATED APPLICATION

This application is a continuation in part of U.S. patent application Ser. No. 08/295,771 filed Aug. 29, 1994 now U.S. Pat. No. 5,526,653.

BACKGROUND OF THE INVENTION

1. Field of Invention

The process and apparatus of the present invention are related to room air cooling and room air heating and based on absorption vapor pressure enhancement operations.

2. Brief Description of the Prior Art

A large scale absorption air conditioning process comprises (a) a step of producing a stream of chilled liquid such as water or an aqueous solution of ethylene glycol at around 7.2° C. (45° F.), in an absorption liquid chiller and (b) a step of circulating a stream of the chilled liquid through air handlers to remove heat from indoor air and thereby return the liquid at around 15.5° C. (60° F.). Manufacturers of absorption chillers are Trane Corp. in Wisconsin and Carrier Corp. in New York State. There are several manufacturers in Japan including Sanyo , Ebara, Mitsubishi and Yasaki. A commercial absorption liquid chiller has a large vacuum enclosure enclosing (a) an evaporation zone, (b) an absorption zone, (c) a regeneration zone and (d) a condensation zone. The processing steps are as follows:

(a) As water enters the evaporation zone, flash vaporization causes formation of a first vapor and a mass of internal chilled water at around 4.4° C. (40° F.). An external chill water at a first temperature around 15.5° C. (60° F.) then exchanges heat with the internal chill water and is thereby cooled to a second temperature at around 7.2 ° C. (45° F.).The chilled external chill water is then circulated to air handlers and heated to the first temperature and returned to the liquid chiller;

(b) The water vapor is dram to the absorption zone and is absorbed in a strong absorbing solution such as 63% aqueous lithium bromide solution. The absorbing solution is thereby diluted and becomes a weak absorbing solution, say 58% lithium bromide. The heat of absorption is released to a cooling water stream;

(c) The weak absorbing solution then enters the regeneration zone, wherein it is heated and vaporized to generate a near ambient pressure water vapor and becomes a strong absorbing solution that is heat exchanged and returned to the absorbing zone;

(d) The near ambient pressure water vapor is condensed by rejecting heat to a cooling water stream and the condensate formed is heat exchanged and returned to the evaporation zone.

The operations in a small conventional absorption air conditioner are similar to those of a larger unit described, except that the internal chilled water produced in the evaporation zone is circulated directly to an air handler.

An Immediate Heat Upgrading Absorption Air Conditioning System. (IHUA System) has been introduced by Chen-Yen Cheng and has been described in U.S. Pat. No. 5,209,071 and corresponding international applications. The system uses Immediate Heat Upgrading Absorption Air Handlers (IHUA air handlers). In this system, an absorption solution consisting of a common salt and water is circulated through the IHUA air handlers to upgrade heat taken from a first air mass or water and release the upgraded heat to a second air mass immediately. Production of chilled water is avoided. An IHUA air handler has one or more Modular Evaporation-Absorption panels (E-A panels) with two sets of heat transfer fin assemblies. An E-A panel has two closely spaced heat conductive walls enclosing a film evaporative zone and a film absorption zone that respectively exchange heat with air to be cooled and air to be heated through the two sets of fin assemblies. A multiple pressure zone IHUA air handler and multiple pressure zone evaporation and absorption operations have been described. It is noted that the present application is a continuation in part application of a U.S. patent application Ser. No. 08/295,771, which is a continuation application of U.S. patent application Ser. No. 851,298 that has become the U.S. Pat. No. 5,209,071 described.

A Vapor Pressure Enhancement Direct Water Chiller, designated as a VPE chiller, a Vapor Pressure Enhancement Direct Water Heater, designated as a VPE heater, and a dual purpose integrated Vapor Pressure Enhancement Direct Water Chiller/Heater, designated as a VPE chiller/heater have been introduced by Chen-yen Cheng and U.S. patent application was mailed on Jul. 15, 1995. The present application is a continuation in part application of this application.

A VPE-chiller comprises multiple pressure processing zones and is based on absorption vapor pressure enhancement operation. It comprises multitude of processing zones, Z-1, Z-2, . . . , Z-N that are operated under pressure $P_1$, $P_2$, . . . , $P_N$. Each pressure zone (Z-n) contains a water evaporation zone (Z-En), a vapor pressure enhancement zone (Z-VPEn) and a second vapor condensing zone (Z-Xn). There are a set of rotating discs; to provide water evaporation surfaces in the evaporation zone; there are flat heat conductive tubes for forming falling films of absorbing solution and falling films of water in the vapor pressure enhancement zone; there are condenser tubes in the condensation zone. A first vapor is absorbed and second vapor is generated in the enhancement zone; the second vapor is condensed in the condensing zone. Outdoor air, cooling water or air/water combination is used to remove the heat of condensation. The construction and operations of a VPE heater is similar to that of a VPE chiller.

BRIEF DESCRIPTION OF THE INVENTION

A Vapor Pressure Enhancement Room Air Cooler, designated as a VPE air cooler, a Vapor Pressure Enhancement Room Air Heater, designated as a VPE air heater, and a dual purpose integrated Vapor Pressure Enhancement Room Air Cooler/Heater, designated as a VPE air cooler/heater are introduced.

A VPE air cooler simultaneously produces a stream of system chill water by vaporizing a stream of system water under a first low pressure and exchanges heat between room air and the system chill water. The water vapor generated is referred to as a first vapor and also as an inner water vapor. The inner water vapor is absorbed into an absorbing solution at an elevated temperature and the heat of absorption is utilized to generate a second vapor that is also refer to as an outer water vapor at a second pressure that is substantially higher than the first pressure. The outer water vapor is condensed by releasing heat of condensation to outdoor air or cooling water. Evaporative condensers may be used to condense the outer water vapor. The diluted absorbing solution is concentrated by an evaporation operation in an absorbing solution regenerator. The transformation from the inner water vapor to the outer water vapor is referred to as an absorption vapor pressure enhancement operation and also simply as a VPE operation. Since the inner vapor and the outer vapor are the inlet vapor and outlet vapor for the VPE operation in the VPE air cooler, they are respectively referred to as the first vapor and second vapor of the VPE operation.

A VPE air heater heats room air by condensing an inner water vapor to be described and releasing the heat of condensation to the room air. First of all, heat is taken in from the environment, for example, from the outdoor air, lake water and river water and some waste heat sources, into the VPE heater to vaporize water under a first pressure to thereby generate a low pressure water vapor. The vapor generated is referred to as an outer water vapor. The outer water vapor is absorbed into an absorbing solution at an elevated temperature and the heat of absorption is utilized to generate a water vapor at a second pressure that is substantially higher than the first pressure. The vapor generated becomes the inner water vapor used to heat the room air. The transformation from the outer water vapor to the inner water vapor in a VPE air heater is also an absorption vapor pressure enhancement (VPE) operation. Since the outer vapor and the inner vapor are respectively the inlet vapor and outlet vapor of the VPE operation, they are respectively referred to as the first and the second vapor of the VPE operation.

Some terminologies that are used in relation to both a VPE air cooler and a VPE air heater are summarized as follows:

(a) "Heat interaction with the environment" refers both to removing heat of condensation by outdoor air or cooling water in a VPE air cooler and generation of outer vapor by vaporizing water upon receiving heat from outdoor air or any low temperature heat source in a VPE heater.

(b) "An environmental heat interaction zone" refers both to the second vapor condensing zone in a VPE air cooler and the outer water vapor generation zone in a VPE air heater.

(c) "An inner water vapor" refers both to the vapor formed in vaporization of the system water in a VPE air cooler and the vapor to be condensed in a VPE air heater.

(d) "An outer water vapor" refers both to the second vapor to be condensed by heat interaction with the environment in a VPE air cooler and the vapor produced by heat interaction with the environment in a VPE air heater.

A VPE air cooler may be divided into a multitude of pressure zones and multiple pressure zone operations may be used to conduct the vaporization, first vapor (inner vapor) absorption, second vapor (outer vapor) generation and second vapor (outer vapor) condensation operations. Such a VPE Air Cooler may be referred to as a Vapor Pressure Enhancement Multiple Pressure Zone Room Air Cooler and also referred to as a VPE/MPZ Room Air Cooler or simply as a VPE/MPZ Air Cooler. A VPE-MPZ air cooler comprises multiple processing sub-zones, Z-1 through Z-N. Each pressure sub-zone (Z-n) contains a room air heat interaction water evaporation zone (Z-En), a vapor pressure enhancement zone (Z-VPEn) and an environmental heat interaction second vapor condensing zone (Z-Xn).

There are heat transfer tubes and heat transfer fins in the Z-En zones for vaporizing water and exchanging heat with room air; there are parallel vertical walls or flat tubes made of heat conductive material for forming falling absorbing solution films and forming falling water films in the vapor pressure enhancement zone; there are condenser tubes in the condensation zone to condense the second vapor. In a Type A system, outdoor air is used to remove the heat of condensation and heat transfer fins are provided on the condenser tubes. In a Type B system, cooling water passes inside of the condenser tubes to thereby condense the second vapor outside of the tubes.

The following operational steps take place in each pressure zone:

(1) Water is vaporized in each evaporation zone to generate a first vapor (inner vapor) and produces system chill water;

(2) Room air is cooled by exchanging heat with the system chill water;

(3) The first vapor (inner vapor) is absorbed and a second vapor (an outer vapor) is generated in each vapor pressure enhancement zone (Z-VPEn);

(4) The second vapor (outer vapor) is condensed in each environmental interaction vapor condensing zone (Z-Xn);

(5a) In a Type A VPE/MPZ air cooler, a stream of outdoor air flows through the fins to remove the heat of condensation;

(5b) In a Type B VPE/MPZ air cooler, a stream of cooling water flows through the condenser tubes to remove the heat of condensation.

A VPE air heater may also be divided into multiple pressure zones and multiple pressure zone operations may be used to conduct the heat interactions with the environment, such as outdoor air, and various heat sources, outer vapor generation, outer vapor absorption, inner vapor generation and room air heat interaction and inner vapor condensation. Such a VPE air heater may be referred to as a Vapor Pressure Enhancement Multiple Pressure Zone Room Air Heater and also referred to as a VPE/MPZ Room Air Heater or simply as a VPE/MPZ air heater. The structure of a VPE/MPZ air heater is very similar to that of a VPE/MPZ air cooler. A dual purpose VPE/MPZ air cooler/heater can be used as a VPE/MPZ air cooler and a VPE/MPZ air heater by simply changing the flows of absorbing solution and water streams.

An air conditioning system for a building may have one or more evaporators, referred to as regenerators, for regenerating absorbing solution. A regenerator may concentrate enough absorbing solution to be used in several VPE air coolers, VPE air heaters or VPE air cooler/heaters.

BRIEF DESCRIPTION OF THE DRAWINGS

A VPE air cooler-heater may be used both as a VPE air cooler and a VPE air heater. A VPE air cooler may be divided into a multitude of pressure zones and a multiple pressure zone operations may be used to conduct the vaporization that generates a first vapor, absorption of the first vapor, second vapor generation and second vapor condensation operations described. Such a VPE air cooler may be referred to as a Vapor Pressure Enhancement Multiple Pressure Zone Room Air Cooler and also referred as a VPE/MPZ Room Air Cooler or simply as a VPE/MPZ air cooler.

There are one or more sets of heat transfer tubes with heat transfer fins to provide water evaporating surfaces and exchange heat with room air in the evaporation zone; there are flat tubes made of heat conductive material for forming falling absorbing solution films and forming falling and evaporating water films in the vapor pressure enhancement zone; there are condenser tubes and heat transfer fins in the condensation zone to condense the second vapor.

In operation, the following operational steps take place in each pressure zone:

(1) Water is vaporized in each evaporation zone to generated a first vapor and cool the room air;

(2) The first vapor is absorbed and a second vapor is generated in each vapor pressure enhancement zone;

(3) The second vapor is condensed in each condensing zone;

(4) A stream of outdoor air flow through the fins to remove the heat of condensation.

Figure 5:
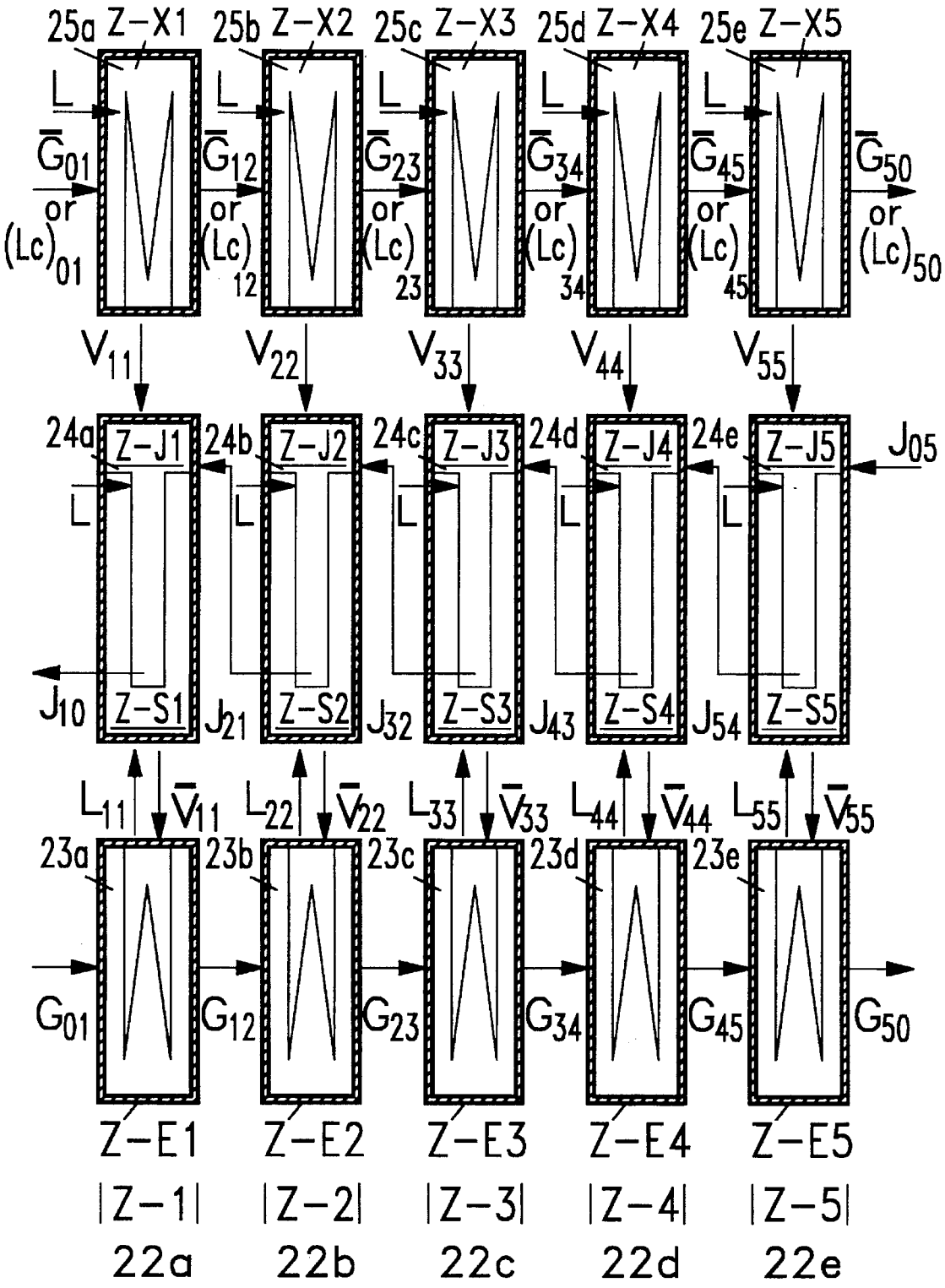

A VPE air heater may also be divided into a multitude of pressure zones and a multiple pressure zone operations may be used to conduct the outer water vapor generation, the vapor pressure enhancement operation transforming the outer water vapor into the inner water vapor and condensation of the inner water vapor to heat the room air. Such a VPE air heater may be referred to as a Vapor Pressure Enhancement Multiple Pressure Zone Room Air Heater and also referred as a VPE/MPZ Room Air Heater or simply as a VPE/MPZ air heater. FIG. 5 illustrates the structure and operations of a VPE/MPZ air heater. Five pressure zone unit is illustrated.

Figure 6:
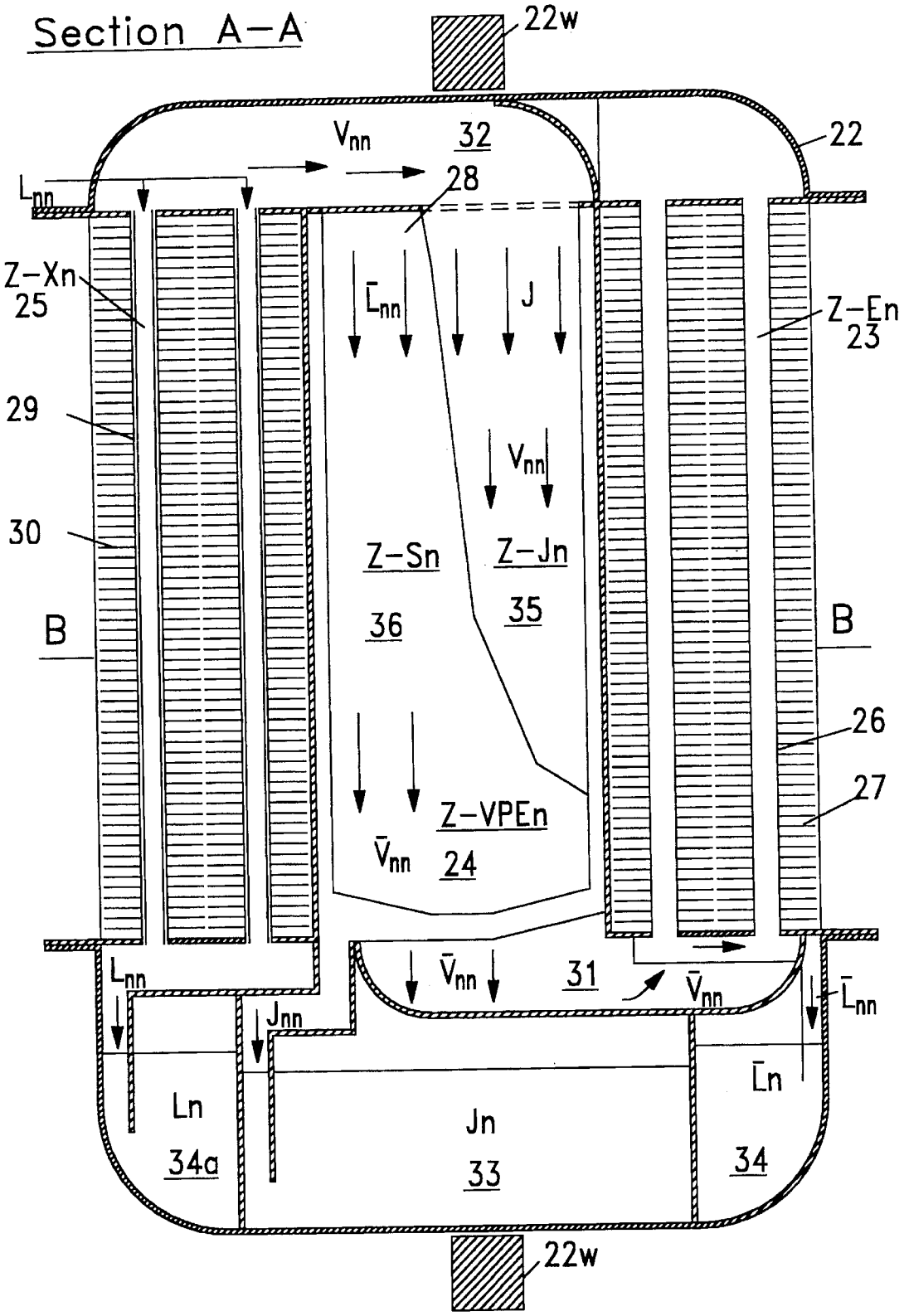
Figure 7:
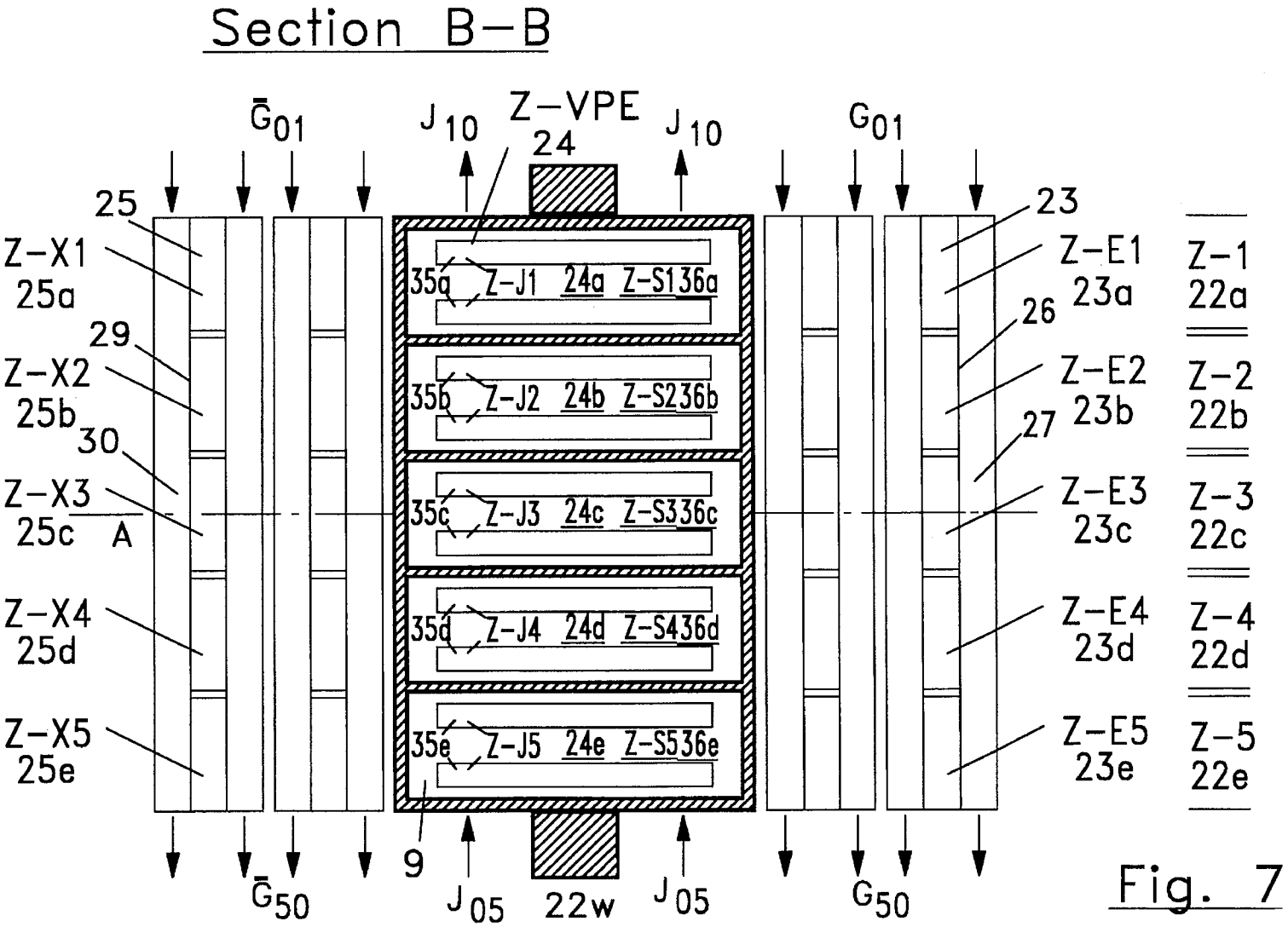

FIG. 6 and 7 respectively illustrate a vertical cross-section, Section A—A, and a horizontal cross-section, Section B—B of a VPE-MPZ air heater. Referring to these figures, a VPE-MPZ air heater comprises a vacuum enclosure and multiple pressure processing sub-zones. In the figures, five processing sub-zones Z-1, Z-2, Z-3, Z-4 and Z-5 are illustrated. Each pressure sub-zone (Z-n) contains an room air heat interaction zone (Z-En), a vapor pressure enhancement zone (Z-VPEn) and an environmental heat interaction zone (Z-Xn).

There are one or more sets of heat transfer tubes with heat transfer fins for condensing inner water vapor in the room air heat interaction zone (Z-En); there are flat tubes or parallel vertical walls made of heat conductive material for forming falling absorbing solution films and forming falling and evaporating water films in the vapor pressure enhancement zone (Z-VPEn); there are heat transfer tubes and heat transfer fins in the environmental heat interaction zone (Z-Xn) to generate the outer water vapor.

In operation, the following operational steps take place in each pressure zone:

(1) In each environmental heat interaction zone. (Z-Xn), heat is received from the outdoor air or other low temperature heat sources to generate an outer water vapor $V_{nn}$;

(2) The outer water vapor $V_{nn}$ is absorbed and an inner water vapor $\overline{V}_{nn}$ is generated in each vapor pressure enhancement zone (Z-VPEn);

(3) The inner vapor $\overline{V}_{nn}$ is condensed and the room air is heated in each room air heat interaction zone (Z-En).

PREFERRED EMBODIMENT OF THE INVENTION

Figure 1:
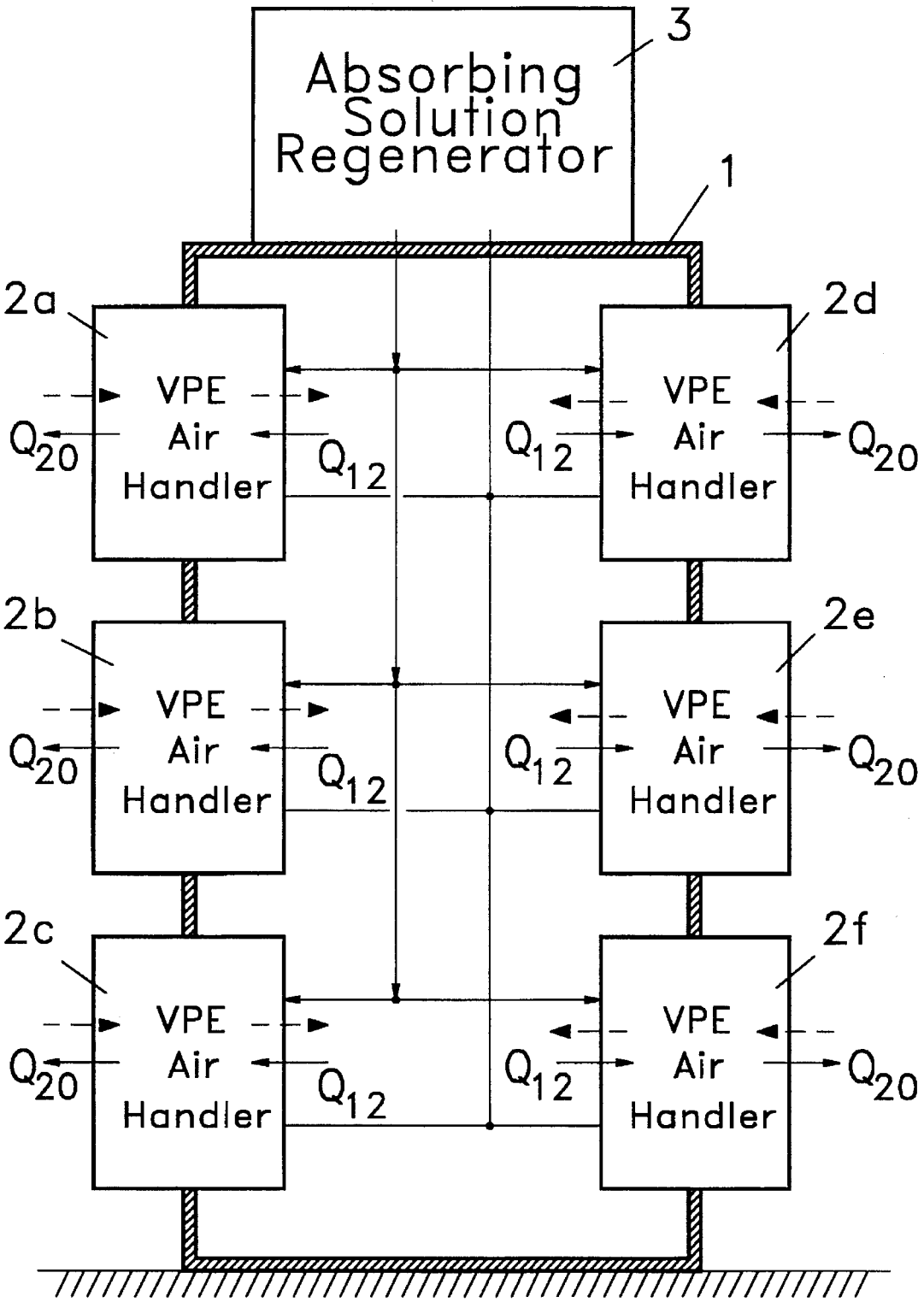
FIG. 1 illustrates a system for providing air conditioning in a building that comprises a multitude of air handlers and an absorbing solution regenerator. An air handler illustrates may either be a Vapor Pressure Enhancement Air Cooler, designated as a VPE air cooler, or a Vapor Pressure Enhancement Air Heater, designated as a VPE air heater. Several VPE air coolers are illustrated in the Figure. A VPE air cooler produces system chill water by vaporizing water under a low pressure and a low temperature and cool the room air by transferring heat from the room air to the system chill water. A first low pressure water vapor (inner water vapor) is generated. The first water vapor is absorbed into an absorbing solution at an elevated temperature and the heat of absorption is utilized to generate a second water vapor (outer water vapor) at a second pressure that is higher than the first pressure. The second water vapor is condensed by releasing heat of condensation to outdoor air or cooling water. Evaporative condensers may be used to condense the second vapor. The diluted absorbing solution is concentrated by an evaporation operation in the absorbing solution regenerator. In a VPE air heater, heat is taken in from the environment, for example, from the outdoor air, lake water and river water and some low temperature heat source, to vaporize water under a first pressure to thereby generate a low pressure water vapor. The vapor generated is referred to as an outer water vapor. The outer water vapor is absorbed into an absorbing solution at an elevated temperature and the heat of absorption is utilized to generate a water vapor at a second pressure that is substantially higher than the first pressure. The vapor generated becomes the inner water vapor used to heat the room air.

FIG. 1 illustrates a system for providing air conditioning in a building 1 with a multitude of air handlers. It comprises one or more Vapor Pressure Enhancement Room Air Cooler/Heaters 2*a* through 2*f*, designated as VPE air cooler/heaters. A VPE air cooler/heater is a dual purpose unit that can be used as an air cooler or an air heater by simple adjustments of the flows of absorbing solutions and water. In a VPE air cooler, system water is vaporized under a low pressure and a low temperature, respectively referred to as a first pressure and a first temperature, to remove heat $Q_{12}$ the room air. The low pressure water vapor generated is referred to as first water vapor. Since the first water vapor is generated from the system water, it is also referred to as an inner water vapor. There is a heat interaction $Q_{12}$ between the room air and the system water through heat transfer tubes and heat transfer fins. This operation is referred to as a "room air heat interaction. The first water vapor is absorbed into an absorbing solution at an elevated temperature and the heat of absorption is utilized to generate a second water vapor at a second pressure that is higher than the first pressure. The second water vapor is condensed by releasing heat of condensation $Q_{20}$ to outside air or cooling water. Since the second vapor enters into a heat exchange relation with the environment such as with outdoor air or cooling water, it is also referred to as an outer water vapor. One may also use evaporative condensers in condensing the second vapor streams. In an evaporative condenser, water is applied on the condensing surfaces and heat of absorption is removed by vaporizing the water on the surface and the water vapor generated is carried away by the circulating air. The circulating air stream is both heated and humidified. An evaporation condenser may be considered as a combination of a condenser and a cooling tower. By using an evaporative condenser, the use of a cooling tower is not needed. The diluted absorbing solution is concentrated by an evaporation operation in an absorbing solution regenerator 3. The heat interaction with the outdoor air, cooling water or by an evaporative condenser are referred to as "environmental heat interactions.". When the air handlers are VPE air heaters, heat $Q_{20}$ is taken in form the environment such as outdoor air, a water stream or any low temperature heat source and heat $Q_{12}$ is given to the room air. The operations are just the reverse operations of those described with VPE air cooler.

A VPE air cooler may be divided into a multitude of pressure zones and multiple pressure zone operations may be used to conduct the room air heat interaction and water vaporization generating first vapor (inner vapor), first vapor absorption, second vapor (outer vapor) generation and second vapor condensation operations described. Such a VPE air cooler may be referred to as a Vapor Pressure Enhancement Multiple Pressure Zone Room Air Cooler and also referred as a VPE/MPZ Room Air Cooler or simply as a VPE/MPZ air cooler. Operations conducted in a multiple pressure zone air cooler has many advantages over operations conducted in a single pressure zone air cooler. These advantages are:

1. Temperature driving forces are more effectively utilized;

2. Thermodynamically, the operations are more efficient;

3. The concentration of the absorbing solution used is considerably lower;

4. The operating concentration range is much larger;

5. The coefficient of performance (C.O.P.) value is considerably higher.

Figure 2:
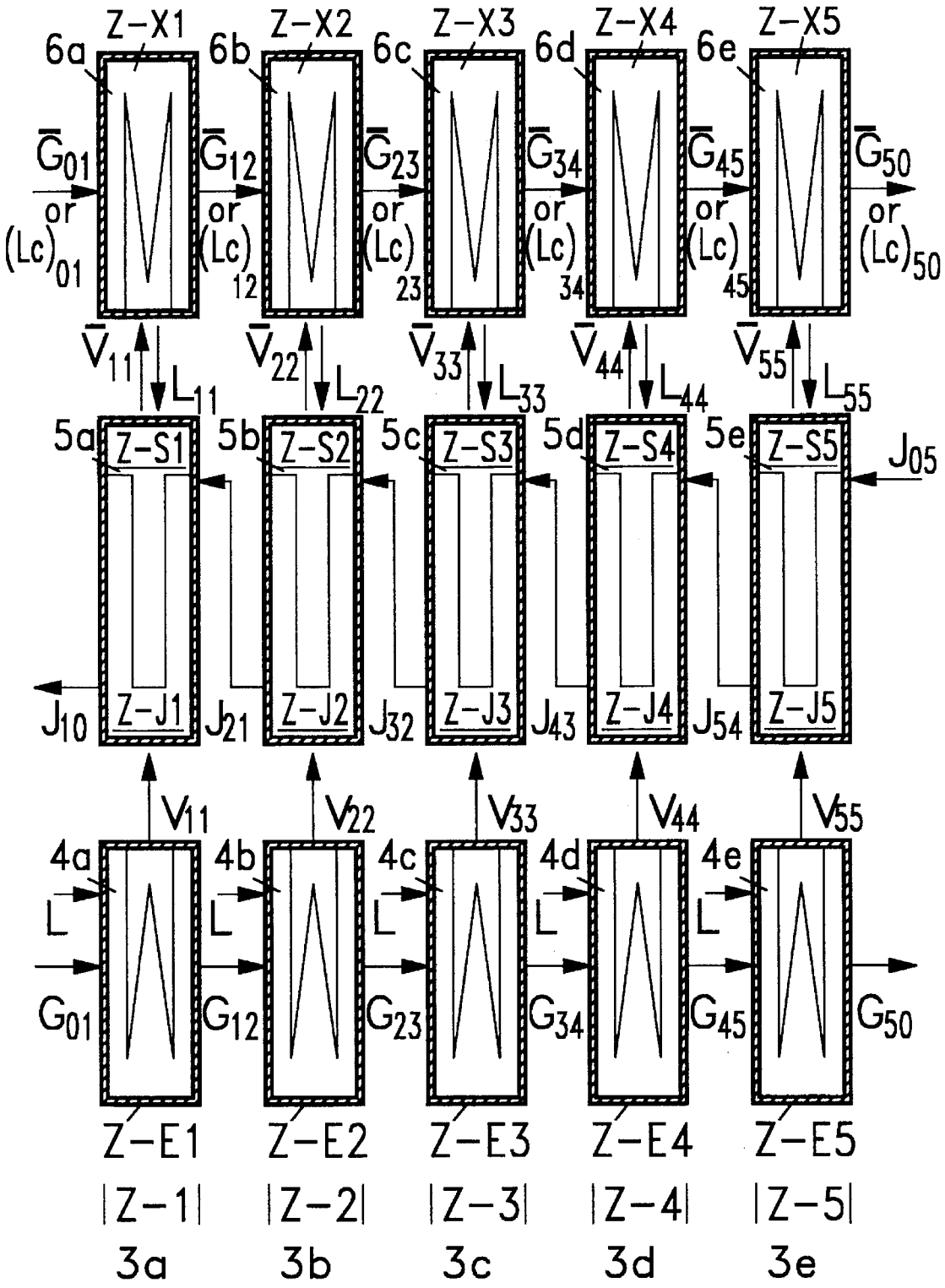
FIG. 2 illustrates the structure and operations of a VPE/MPZ air coolers. Five pressure zone unit is illustrated.

FIG. 2 illustrates the structure and operations of a VPE/MPZ air cooler. Five Pressure zone unit is illustrated. It comprises five pressure sub-zones, designated as Z-1 (3*a*), Z-2 (3*b*), Z-3 (3*c*), Z-4 (3*d*), and Z-5 (3*e*). There are room air heat interaction sub-zone Z-En, a vapor pressure enhancement sub-zone Z-VPEn and an environmental heat interaction sub-zone Z-Xn in each pressure sub-zone. Each vapor pressure enhancement sub-zone, Z-VPEn, comprises a first vapor absorption sub-zone Z-Jn and a second vapor generation sub-zone Z-Sn. Therefore, there are Z-En, Z-Jn, Z-Sn, Z-Xn sub-zones in Z-n pressure sub-zone, where n is 1 through 5.

In the first step operation, water is added and the water is vaporized by heat interaction with room air in Z-E1 4*a*, Z-E2 4*b*, Z-E3 4*c*, Z-E4 4*d*, and Z-E5 4*e* under successively lower pressures $(P_E)_1$, $(P_E)_2$, $(P_E)_3$, $(P_E)_4$ and $(P_E)_5$. First water vapor streams $V_{11}$, $V_{22}$, $V_{33}$, $V_{44}$, $V_{55}$, also referred to as the inner water vapors, are generated and the room air $G_{01}$ is successively cooled to become $G_{12}$, $G_{23}$, $G_{34}$, $G_{45}$, $G_{50}$. The final chilled room air $G_{50}$ is circulated to the room and recycled back with some make up air to become $G_{01}$. This operation is referred to as room air heat interaction operation.

The second step operation is a vapor pressure enhancement operation. A description of the vapor pressure enhancement operation by absorption and an apparatus to be used therein have been described by Chen-Yen Cheng in U.S. Pat. No. 5,061,306. Such apparatus and operations are used in each vapor pressure enhancement sub-zone, designated as a VPEn sub-zone or Z-VPEn. A VPEn sub-zone comprises a first vapor absorption sub-zone and a second vapor generation sub-zone, respectively designated as Z-Jn sub-zone and Z-Sn sub-zone. A VPE sub-zone comprises a multitude of vertical heat conductive walls or flat tubes that separate the first vapor absorption sub-zone Z-Jn from the second vapor generation sub-zone Z-Sn. A falling film of an absorbing solution and a falling film of water are respectively applied on the two surfaces of each vertical wall. A stream of first vapor $V_{nn}$ is absorbed into the absorbing solution in Z-Jn sub-zone at a temperature higher than the saturation temperature of the first vapor. The absorbing solution is thereby diluted to become a weaker absorbing solution. The heat of absorption is transmitted through the vertical wall to vaporize water in Z-Sn sub-zone, generating a stream of second vapor $\overline{V}_{nn}$ that is also referred to as an outer water vapor.

In the system illustrated, there are five vapor pressure enhancement sub-zones, designated as Z-VPE1 5*a*, and Z-VPE2 5*b*, Z-VPE3 5*c*, Z-VPE4 5*d*, Z-VPE5 5*e*. There are five first vapor absorption sub-zones, designated as Z-J1, Z-J2, Z-J3, Z-J4 and Z-J5 and five second vapor generation sub-zones, designated as Z-S1, Z-S2, Z-S3, Z-S4 and Z-S5 in these vapor pressure enhancement sub-zones.

In operation, a strong absorbing solution $J_{05}$ from a regenerator is introduced into Z-J5 sub-zone as falling film, a water stream $L_{55}$ is introduced into Z-S5 sub-zone as a falling film and the first vapor $V_{55}$ is brought in contact with the absorbing solution in Z-J5. The absorbing solution absorb the first vapor to become a weaker solution $J_{54}$ which is introduced in Z-J4 as a falling film. The heat of absorption is transmitted through the vertical wall to vaporize the water in Z-S5 to generated a second vapor $V_{55}$ at a pressure substantially higher than the saturation temperature of the first vapor $V_{55}$.

Similar operations are conducted in the other VPE sub-zones, Z-VPE4, Z-VPE3, Z-VPE2 and Z-VPE1. The operations conducted in all the VPE sub-zones may be summarized as follows:

1. Absorbing solution $J_{05}$ and water $L_{55}$ are respectively introduced into Z-J5 and Z-S5 to form falling films and first vapor $V_{55}$ is brought in contact with the absorbing solution in Z-J5. A weakened solution $J_{54}$ is formed and a second vapor $\overline{V}_{55}$ is generated.

2. Absorbing solution $J_{54}$ and water $L_{44}$ are respectively introduced into Z-J4 and Z-S4 to form falling films and first vapor $V_{44}$ is brought in contact with the absorbing solution in Z-J4. A weakened solution $J_{43}$ is formed and a second vapor $\overline{V}_{44}$ is generated.

3. Absorbing solution $J_{43}$ and water $L_{33}$ are respectively introduced into Z-J3 and Z-S3 to form falling films and first vapor $V_{33}$ is brought in contact with the absorbing solution in Z-J3. A weakened solution $J_{32}$ is formed and a second vapor $\overline{V}_{33}$ is generated.

4. Absorbing solution $J_{32}$ and water $L_{22}$ are respectively introduced into Z-J2 and Z-S2 to form falling films and first vapor $V_{22}$ is brought in contact with the absorbing solution in Z-J2. A weakened solution $J_{21}$ is formed and a second vapor $V_{22}$ is generated.

5. Absorbing solution $J_{21}$ and water $L_{11}$ are respectively introduced into Z-J 1 and Z-S1 to form falling films and first vapor $V_{11}$ is brought in contact with the absorbing solution in Z-J1. A weakened solution $J_{10}$ is formed and a second vapor $\overline{V}_{11}$ is generated.

The third step operation is condensation of second vapor streams. There are condensing sub-zone Z-X1 6*a*, Z-X2 6*b*, Z-X3 6*c*, Z-X4 6*d* and Z-X5 6*e* for condensing the second vapor streams $\overline{V}_{11}$, $\overline{V}_{22}$, $\overline{V}_{33}$, $\overline{V}_{44}$, $\overline{V}_{55}$ respectively. Outdoor air or cooling water may be used to remove the heat of condensation. It shows that outdoor air $G_{01}$ flow successively through the sub-zones to condense the second vapors $\overline{V}_{11}$, $\overline{V}_{22}$, $\overline{V}_{33}$, $\overline{V}_{44}$ and $\overline{V}_{55}$ and thereby from condensate streams $L_{11}$, $L_{22}$, $L_{33}$, $L_{44}$ and $L_{55}$ which are respectively recycled to Z-S1, Z-S2, Z-S3, Z-S4 and Z-S5 sub-zones. The air $G_{01}$ is heated successively to become $G_{12}$, $G_{23}$, $G_{34}$, $G_{45}$ and $G_{50}$. When outside air is used to provide the cooling, it is desirable to use heat transfer fins to enhance heat transfer.

One may use a cooling water stream $(L_c)_{01}$ instead of the outdoor air $G_{01}$. The cooling water is successively heated by removing the heat of condensation of the second vapor streams and becomes $L_c)_{12}$, $L_c)_{23}$, $L_c)_{34}$, $L_c)_{45}$ and $L_c)_{50}$. The heated water $L_c)_{50}$ is processed in a cooling tower to be cooled and returned as $L_c)_{01}$. As has been described, one may also use evaporative condensers in condensing the second vapor streams.

Since each of these second vapor condensation zone has a heat interaction with the environment, such as with outdoor air or cooling water, it is also referred to as "an environmental heat interaction zone."

Figure 3:
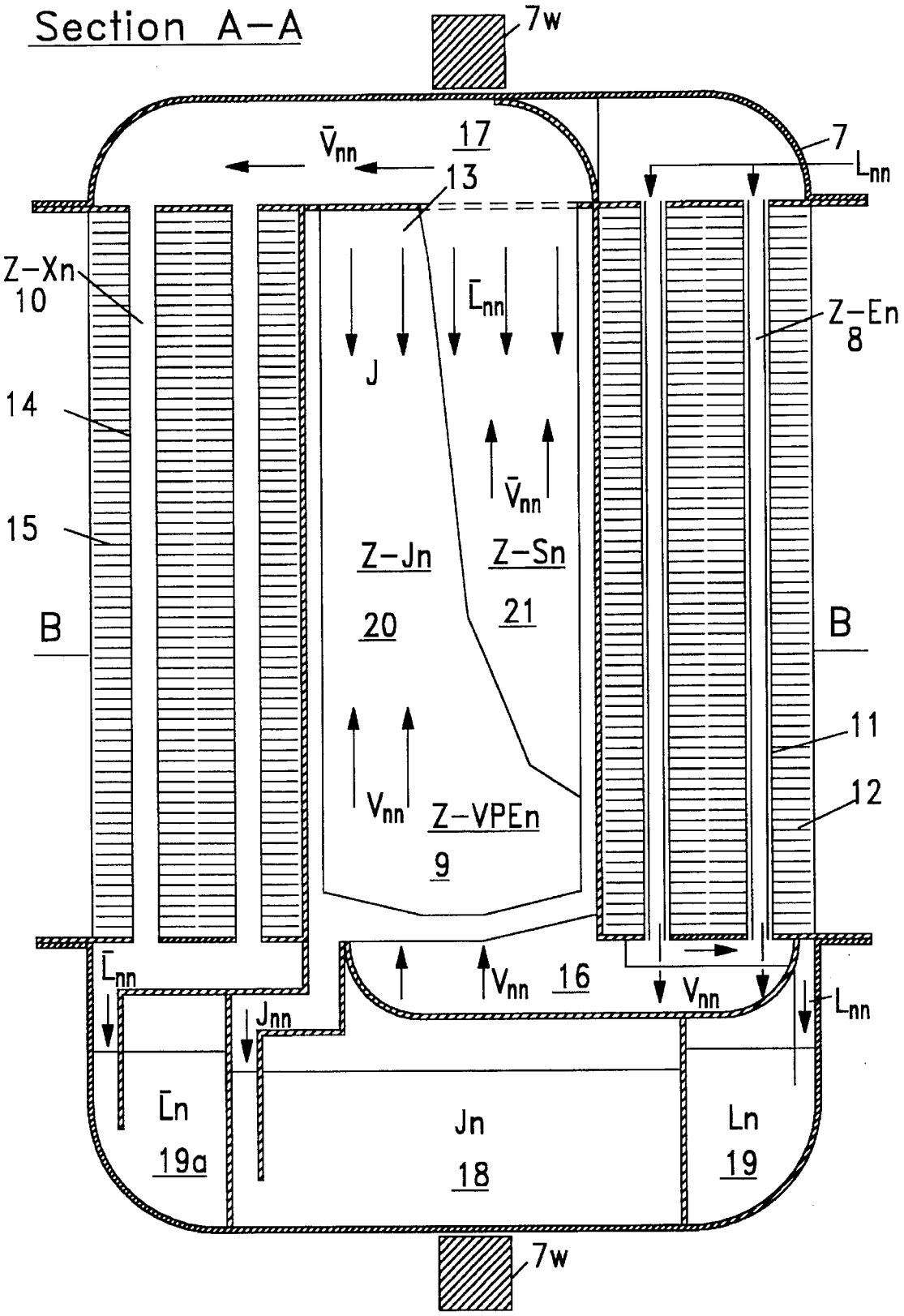
FIG. 3 and 4 respectively illustrate a vertical cross-section, Section A—A, and a horizontal cross-section, Section B—B of a VPE-MPZ air cooler. Referring to these figures, a VPE-MPZ air cooler comprises a vacuum enclosure and multiple pressure processing sub-zones. In the Figures, five processing sub-zones Z-1, Z-2, Z-3, Z-4 and Z-5 are illustrated. Each 5pressure sub-zone (Z-n) contains a water evaporation zone (Z-En), a vapor pressure enhancement zone (Z-VPEn) and a second vapor condensation zone (Z-Xn).
Figure 4:
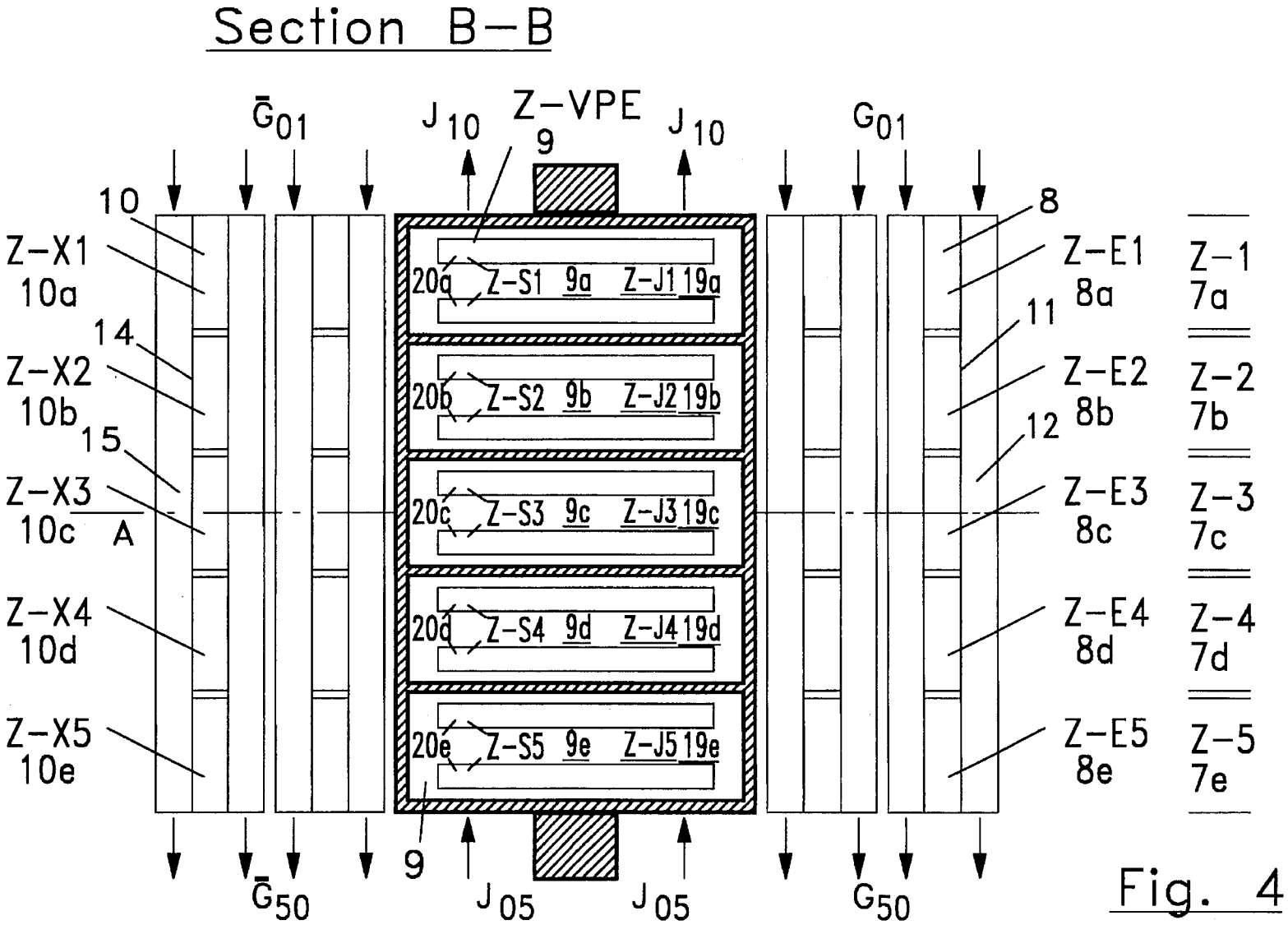

FIGS. 3 and 4 respectively illustrate a vertical cross-section. Section A—A, and a horizontal cross-section, Section B—B of a VPE-MPZ Room Air Cooler. Referring to these Figures, a VPE-MPZ air cooler comprises a vacuum enclosure 7 and multiple pressure processing sub-zones. In the figure, five processing sub-zones Z-1 (7*a*), Z-2 (7*b*), Z-3 (7*c*), Z-4 (7*d*) and Z-5 (7*e*) are illustrated. Each pressure sub-zone (Z-n) contains a room air heat interaction zone (Z-En) 8, a vapor pressure enhancing zone (Z-VPEn) 9, and an environmental heat interaction zone (Z-Xn) 10.

There are one or more heat transfer tubes 11 and heat transfer fins 12, two sets being shown, to cool the room air and vaporize system water in the room air heat interaction zone: there are flat tubes 13 made of heat conductive material for forming falling absorbing solution films and forming falling evaporating water films in the vapor pressure enhancing zone; there are condenser tubes 14 and heat transfer fins 15 in the environmental heat interaction zone to condense the second vapor streams. There are vapor passages 16 for transferring vapor from the room air heat interaction zone (Z-En) to the vapor pressure enhancing zone (Z-VPEn); there are vapor passages 17 for transferring vapor from the vapor pressure enhancing zone (Z-VPEn) to the environmental heat interaction zone (Z-Xn). There are a storage and a pumping devices 18 for an absorbing solution and there are two water storages 19 and 19*a* and pumping devices for water in each pressure zone. In each vapor pressure enhancing zone, there is a vapor absorption zone (Z-Jn) 20 and a second vapor generation zone (Z-Sn) 21. The former zone is the zone outside of the flat tubes 13 and the latter zone is the zone inside of the flat tubes 13.

In operation, the vessel 7 is evacuated, system water $L_{nn}$ is introduced into the heat transfer tubes in Z-E1, Z-E2, Z-E3, Z-E4 and Z-E5, room air flows through the fins in the direction from Z-E1 to Z-E5, absorbing solution $J_{on}$ is introduced into storage tanks $J_n$, circulating pumps for circulating the absorbing solutions and water are activated to form falling films of absorbing solution and water in the absorption zones (Z-Jn) 20 and the second vapor generation zones (Z-Sn) 21. Outdoor air is blown through the heat transfer fins in the direction from Z-1 through Z-5.

Then, the system water $L_{nn}$ vaporizes upon receiving heat from room air in Z-E1 to Z-E5 to form first vapors $V_{11}$, $V_{22}$, $V_{33}$, $V_{44}$ and $V_{55}$ and produces chilled room air $G_{50}$. The first vapor $V_{nn}$ passes through the vapor passage 16 and is absorbed by the absorbing solution in the absorbing zone (Z-Jn) 20 and the heat of absorption is transmitted to the water in the falling water film in the second vapor generation zone (Z-Sn) 21 to generate second vapor $\overline{V}_{nn}$. The second vapor $\overline{V}_{nn}$ passes through the vapor passage 17 and is condensed in the condenser tubes 14. The heat of condensation is transmitted through the heat transfer fins 15 to the outdoor air. The outdoor air flows through the heat transfer fins in the direction from Z-X1 to Z-X2 and is heated and discharged.

As has been described, one may use cooling water to remove heats of condensing the second vapor streams; one may also use evaporative condensers in removing the heat of condensing the second vapor streams.

FIG. 5 illustrates the structure and operations of a VPE/MPZ air heater. Five pressure zone unit is illustrated. It comprises five pressure sub-zones, designated as Z-1 (22*a*) through Z-5 (22*e*). There are room air heat interaction zones, designated as Z-E1 (23*a*) through Z-E5 (23*e*); there are vapor pressure enhancement zones, designated as Z-VPE1 (24*a*) through Z-VPE5 (24*e*); there are environmental heat interaction zones, designated as Z-X1 (25*a*) through Z-X5 (25*e*). Each vapor pressure enhancement sub-zone, Z-VPEn, comprises an outer vapor absorption sub-zone Z-Jn and an inner vapor generation sub-zone Z-Sn. Therefore, there are outer vapor absorption zones, designated as Z-J1 through Z-J4 zones 35 and inner vapor generation zones, designated as Z-S1 through Z-S5 zones 36.

The structure of the system illustrated in FIG. 5 is very similar to that the system illustrated by FIG. 2. There are heat transfer tubes with heat transfer fins in Z-E1 through Z-E5 for heat interaction between room air and system water; there are flat tubes in Z-VPE1 through Z-VPE5 for forming liquid films of absorbing solution and falling water films; there are heat transfer tubes in Z-X1 through Z-X5 for receiving heat from the environment and evaporating water.

In operation, water is added to Z-X1 through Z-X5, water is added to Z-S1 through Z-S5, absorbing solution $J_{05}$ is introduced into Z-J5 and diluted absorbing solutions are successively introduced into Z-J4 through Z-J1 as $J_{54}$ through $J_{21}$ and finally discharged from Z-J1 as $J_{10}$. The absorbing solutions form falling films in Z-J1 through Z-J5 and water forms falling films in Z-S1 through Z-S5. Room air flows through Z-E1 to Z-E5. Then the following operations take place:

1. Outer water vapor streams $V_{11}$ through $V_{55}$ are generated in Z-X1 through Z-X5;

2. The outer water vapor streams are absorbed into absorbing solutions in Z-J1 through Z-J 5;

3. Water is vaporized in Z-S1 through Z-S5 upon receiving heat of absorption from Z-J1 through Z-J5, generating inner water vapor streams $\overline{V}_{11}$ through $\overline{V}_{55}$;

4. The inner water vapor streams $\overline{V}_{11}$ through $\overline{V}_{55}$ condenses by exchanging heat with room air to heat the room air successively. The room is heated successively, $G_{01}$ through $G_{50}$, as it flows through Z-E1 to Z-E5.

The vapor pressure enhancement operations are similar to those described by referring to FIG. 2.

Z-X1 zone through Z-X5 zone are referred to as "environmental heat interaction zones" or simply as "heat interaction zones" and the operations conducted in these zones are referred to as "environmental heat interactions." Z-E1 through Z-E5 are referred to as "room air heat interaction zones" and the operations conducted in these zones are referred to as "room air heat interactions." Since water is vaporized in Z-X1 through Z-X5 by receiving heat from the environment, such as outdoor air, the vapor streams generated, $V_{11}$ through $V_{55}$ are referred to as outer water vapor streams. Since the water vapor streams, $\overline{V}_{11}$ through $\overline{V}_{55}$, are condensed by exchanging heat with room air, they are referred to as inner water vapors. Since the outer water vapor $V_{nn}$ and inner water vapor $\overline{V}_{nn}$ in a pressure zone Z-n are respectively the inlet vapor and outlet vapor of the vapor pressure enhancement operation in Z-VPEn, they are referred to respectively as the first vapor and second vapor in reference to the VPE operation.

FIGS. 6 and 7 respectively illustrate a vertical cross-section. Section A—A, and a horizontal cross-section, Section B—B of a VPE-MPZ Room Air Heater. Referring to these Figures, a VPE-MPZ air heater comprises a vacuum enclosure 22 and multiple pressure processing sub-zones. In the figure, five processing sub-zones Z-1(22*a*), Z-2(22*b*), Z-3(22*c*), Z-4(22*d*) and Z-5(22*e*) are illustrated. Each pressure sub-zone (Z-n) contains a room air heat interaction zone (Z-En) 23, a vapor pressure enhancement zone (Z-VPEn) 24, and an environmental heat interaction zone (Z-Xn) 25.

There are one or more heat transfer tubes 26 and heat transfer fins 27 for transferring heat from system water to room air in the room air heat interaction zone (Z-En) 23; there are fiat tubes 28 made of heat conductive material for forming falling absorbing solution films and forming falling and evaporating water films in the vapor pressure enhancing zone; there are heat transfer tubes 29 and heat transfer fins 30 in the environmental heat interaction zone (Z-Xn) 25 to generate the outer vapor streams. There are vapor passages 31 for transferring vapor from the vapor pressure enhancing zone (Z-VPEn) 24 to the room air heat interaction zone (Z-En) 23; there are vapor passages 32 for transferring outer vapor from the environmental heat interaction zone (Z-Xn) 25 to the vapor pressure enhancement zone (Z-VPEn) 24. There are a storage and a pumping device 33 for an absorbing solution and there are storages and pumping devices 34 and 34a for water in each pressure zone. In each vapor pressure enhancing zone, there is a vapor absorption zone (Z-Jn) 35 and a inner vapor generation zone (Z-Sn) 36. The former zone is the zone inside of the fiat tubes 28 and the latter zone is the zone outside of the fiat tubes 28.

In operation, the vessel 22 is evacuated,room air $G_{01}$ is allowed to flow successively through Z-E1, Z-E2, Z-E3, Z-E4 and Z-E5, absorbing solution $J_{on}$ is introduced into storage tanks $J_n$, circulating pumps for circulating the absorbing solutions and water are activated to form falling films of absorbing solution and water in the absorption zone (Z-Jn) 35 and the inner vapor generation zones (Z-Sn) 36. Water is added to the heat transfer tubes 29 to form falling water films and outdoor air is blown through the heat transfer fins in the direction from Z-X1 through Z-X5. Then the following operations take place:

1. Water vaporizes in Z-X1 through Z-X5 to generate outer water vapors $V_{11}$ through $V_{55}$;
2. The outer water vapor streams are absorbed into the absorbing solution in Z-VPE1 through Z-VPE5;
3. The heats of absorption generated in Z-J1 through Z-J5 are transferred to Z-S1 through Z-S5 to generate inner water vapor streams $\overline{V}_{11}$ through $\overline{V}_{55}$;
4. The inner water vapor streams are condensed by transferring heat to room air in Z-E1 through Z-E5 to heat the room air $G_{01}$ successively to become heated room air $G_{50}$.

Since the structure and operations of a VPE-air heater and a VPE-air cooler quite similar, one can construct and operate a dual purpose VPE air cooler/heater.

What are claimed are as follows:

1. A process of transforming a stream of internal air into a product stream of cooled air or a product stream of heated air that comprises 1. A first step of subjecting the internal air stream to a heat interaction
   (a) with a system water that is under a low pressure to thereby generate a first low pressure vapor, referred to as an inner water vapor and produce the cooled air, or
   (b) with a system water vapor, referred to as an inner water vapor, to thereby condense the water vapor and produce the heated air;
2. A second step of entering a heat interaction with the environment to
   (a) condense a water vapor, referred to as an outer water vapor by rejecting heat of condensation to the environment, or
   (b) vaporize water: to generate a water vapor, referred to as an outer water vapor by receiving heat from the environment,
3. A third step of subjecting the inner water vapor and the outer water vapor to an absorption vapor pressure enhancement operation of
   (a) absorbing the inner water vapor into an absorbing solution and transfer the heat of absorption through a heat conductive wall to vaporize water and thereby generate the outer water vapor, the pressure of the outer water vapor being substantially higher than the pressure of the inner water vapor, or
   (b) absorbing the outer water vapor into an absorbing solution and transfer the heat of absorption through a heat conductive wall to vaporize water and generate the inner water vapor, the pressure of the inner water vapor being substantially higher than the pressure of the outer water vapor.

2. A process of claim 1, wherein the product stream is cooled air and is characterized in that:

1. The first step is a vaporization operation to thereby generate the inner water vapor;
2. The third step comprises a sub-step of absorbing the inner water vapor into the absorbing solution and a sub-step of utilizing the heat of absorption to generate the outer water vapor;
3. The second step is condensation of the outer water vapor by rejecting heat of condensation to the environment.

3. A process of claim 2, wherein the process is conducted in multiple pressure zones, successively designated as Z-1 through Z-N zones and is characterized in that:

1. Each pressure zone Z-n comprises a vaporization zone Z-En, a vapor pressure enhancement zone Z-VPEn and vapor condensation zone Z-Xn;
2. The vapor pressure enhancement zone Z-VPEn comprises an inner water vapor absorption zone Z-Jn and an outer water vapor generation zone Z-Sn;
3. Room air flows successively through Z-En zones in the direction from Z-E1 to Z-EN and the absorbing solution flows successively through Z-Jn zones in the direction from Z-JN to Z-J1;
4. The inner water vapor generated in a given pressure zone Z-En is subjected to the vapor pressure enhancement operation conducted in Z-VPEn zone to generate outer water vapor and the outer water vapor is condensed in the heat interaction zone Z-Xn.

4. A process of claim 3, wherein the outer water vapor is condensed in Z-Xn zones by rejecting heat to the outdoor air.

5. A process of claim 3, wherein the outer water vapor is condensed in Z-Xn zone by rejecting heat to a cooling water stream.

6. A process of claim 3, wherein the outer water vapor is condensed by an evaporative cooling operation.

7. A process of claim 1, wherein the product stream is heated air and is characterized in that:

1. The second step is vaporization of water by receiving heat from the environment to thereby generate the outer water vapor;

2. The third step comprises a sub-step of absorbing the outer water vapor into an absorbing solution and a sub-step of utilizing the heat of absorption to generate the inner water vapor;

3. The first step is heat interaction of the inner water vapor with the air stream to thereby simultaneous condense the inner water vapor and raise the temperature of the air stream.

8. A process of claim 7, wherein the process is conducted in multiple pressure zones, successively designated as Z-1 through Z-N zones and is characterized in that:

1. Each pressure zone Z-n comprises an internal air heat interaction zone Z-En, a vapor pressure enhancement zone Z-VPEn and an environmental heat interaction zone Z-Xn;

2. The vapor pressure enhancement zone Z-VPEn comprises an outer water vapor absorption zone Z-Jn and an inner water vapor generation zone Z-Sn;

3. The internal air flows successively through Z-En zones in the direction from Z-E1 to Z-EN and the absorbing solution flows successively through Z-Jn zones in the direction from Z-JN to Z-J1.

4. The outer water vapor generated in a given pressure zone Z-Xn is subjected to the vapor pressure enhancement operation in Z-VPEn zone to generate inner water vapor and the inner water vapor enters into a heat interaction with the internal air in zone E-n to condense therein and raise the internal air temperature.

9. A process of claim 8, wherein water is vaporized in Z-Xn zone to generate the outer water vapor by receiving heat from the outdoor air.

10. A process of claim 8, wherein water is vaporized in Z-Xn zone to generate the outer water vapor by receiving heat from a water stream.

11. An apparatus for transforming a stream of internal air into a product stream of cooled air or a product stream of heated air that comprises:

1. An internal air heat interaction zone, designated as Z-E zone, having means for providing heat exchange areas for subjecting the internal air to a heat interaction
   (a) with system water under a low pressure to thereby generate a low pressure inner water vapor and produce the chilled water, or
   (b) with a system water vapor stream, referred to as an inner water vapor to thereby condense the water vapor and produce the heated air;

2. An environmental heat interaction zone, designated as Z-X zone, provided with heat transfer tubes to receive heat from the environment or reject heat to the environment to thereby
   (a) condense an outer water vapor, or
   (b) generate an outer water vapor;

3. A vapor pressure enhancement zone, designated as Z-VPE zone, that comprises a vapor absorption zone, designated as Z-J zone, and a vapor generation zone, designated as Z-S zone, to thereby
   (a) absorb the inner water vapor and generate the outer water vapor, or
   (b) absorb the outer water vapor and generate the inner water vapor.

12. An apparatus of claim 11, wherein the product stream is cooled air and is characterized in that:

1. Vaporization of system water takes place in the Z-E zone;

2. Condensation of the outer water vapor takes place in the Z-X zone;

3. Absorption of the inner water vapor and generation of the outer water vapor take place in the Z-VPE zone.

13. An apparatus of claim 12, wherein the apparatus comprises multiple pressure zones, successively designated as Z-1 through Z-N and is characterized in that:

1. Each pressure zone Z-n comprises an internal air heat interaction zone Z-En, a vapor pressure enhancement zone Z-VPEn and vapor condensation zone Z-Xn;

2. The vapor pressure enhancement zone Z-VPEn comprises an inner water vapor absorption zone Z-Jn and an outer water vapor generation zone Z-Sn;

3. Internal air flows successively through Z-En zones in the direction from Z-E1 to Z-EN and the absorbing solution flows successively through Z-Jn zones in the direction from Z-JN to Z-J1;

4. The inner water vapor generated in a given pressure zone Z-En is subjected to the vapor pressure enhancement operation conducted in Z-VPEn zone to generate outer water vapor and the outer water vapor is condensed in the environmental heat interaction zone Z-Xn.

14. An apparatus of claim 13 wherein the outer water vapor is condensed in Z-X zone by rejecting heat to the outdoor air.

15. An apparatus of claim 13 wherein the outer water vapor is condensed in Z-X zone by rejecting heat to a cooling water stream.

16. An apparatus of claim 13 wherein the outer water is condensed by an evaporative cooling operation.

17. An apparatus of claim 11, wherein the product stream is heated air and is characterized in that:

1. Condensation of the inner water vapor and heating of internal air take place in the Z-E zone;

2. Generation of the outer water vapor take place in the Z-X zone;

3. Absorption of the outer water and generation of inner water vapor take place in the Z-VPE zone.

18. An apparatus of claim 17, wherein the apparatus comprises multiple pressure zones, successively designated as Z-1 through Z-N and is characterized in that:

1. Each pressure zone Z-n comprises an internal air heat interaction zone Z-En, a vapor pressure enhancement zone Z-VPEn and an environmental heat interaction zone Z-Xn, 2. The vapor pressure enhancement zone Z-VPEn comprises an outer water vapor absorption zone Z-Jn and an inner water vapor generation zone Z-Sn;

3. Internal air flows successively through Z-En zones in the direction from Z-E1 to Z-EN and the absorbing solution flows successively through Z-Jn zones in the direction from Z-JN to Z-J1;

4. The outer water vapor generated in a given pressure zone Z-Xn is subjected to the vapor pressure enhancement operation in Z-VPEn zone to generate inner water vapor and the inner water vapor enters into a heat interaction with the internal air in zone E-n to condense therein and raise the internal air temperature.

19. An apparatus of claim 18, wherein water is vaporized in Z-X zone to generate the outer water vapor by receiving heat from the outdoor air.

20. An apparatus of claim 18, wherein water is vaporized in Z-X zone to generate the outer water vapor by receiving heat from a water stream.

* * * * *